US009027787B2

(12) United States Patent
Eriksson et al.

(10) Patent No.: US 9,027,787 B2
(45) Date of Patent: May 12, 2015

(54) MEDICINE DISPENSING DEVICE WITH LOCKING INTERACTION BETWEEN HATCH AND DIVIDING WALL

(76) Inventors: Mats Eriksson, Motala (SE); Ingemar Hagerbro, Motala (SE)

( * ) Notice: Subject to any disclaimer, the term of this patent is extended or adjusted under 35 U.S.C. 154(b) by 60 days.

(21) Appl. No.: 13/989,619

(22) PCT Filed: Nov. 24, 2011

(86) PCT No.: PCT/SE2011/000212
§ 371 (c)(1),
(2), (4) Date: May 24, 2013

(87) PCT Pub. No.: WO2012/070995
PCT Pub. Date: May 31, 2012

(65) Prior Publication Data

US 2013/0248553 A1 Sep. 26, 2013

(30) Foreign Application Priority Data

Nov. 26, 2010 (SE) ..... 1001137

(51) Int. Cl.
*A61J 7/04* (2006.01)
*A61J 1/03* (2006.01)
*B65D 83/04* (2006.01)

(52) U.S. Cl.
CPC *A61J 1/03* (2013.01); *A61J 7/0481* (2013.01); *A61J 2007/0445* (2013.01); *B65D 83/0454* (2013.01); *B65D 2583/0495* (2013.01)

(58) Field of Classification Search
CPC ..... A61J 7/04; A61J 2007/0418; A61J 2007/0445
USPC ..... 221/9, 15, 90, 120, 82, 83
See application file for complete search history.

(56) References Cited

U.S. PATENT DOCUMENTS

| | | | | |
|---|---|---|---|---|
| 2,819,814 | A * | 1/1958 | Hatch | 221/83 |
| 3,876,269 | A * | 4/1975 | Fisher et al. | 312/234.1 |
| 4,078,661 | A * | 3/1978 | Thomas | 206/533 |
| 4,572,403 | A * | 2/1986 | Benaroya | 221/3 |
| 4,748,600 | A * | 5/1988 | Urquhart | 368/10 |
| 5,392,952 | A * | 2/1995 | Bowden | 221/15 |
| 5,405,045 | A * | 4/1995 | Usmani | 221/7 |

(Continued)

FOREIGN PATENT DOCUMENTS

WO 9619178 A1 6/1996

OTHER PUBLICATIONS

International Search Report, dated Jun. 3, 2012, from corresponding PCT application.

*Primary Examiner* — Patrick Mackey
(74) *Attorney, Agent, or Firm* — Young & Thompson

(57) ABSTRACT

A medicine dispensing device includes a shell-like base unit, a shell-like cassette with a number of compartments for storage of medicines which is rotatable relative to the base unit, a unit for rotating the cassette relative to the base unit at predetermined times, a lid firmly connected to the base unit, and an aperture situated in the lid in such a way as to be movable to become central to any desired compartment of the cassette when the cassette is rotated relative to the base unit and the lid. A hatch is provided close to the aperture and can assume a position in which the aperture is closed and a position in which the aperture is exposed. The hatch is pivotable relative to a pivot axis. The hatch has a rear edge which has an extent in the circumferential direction of the device.

16 Claims, 6 Drawing Sheets

(56) References Cited

U.S. PATENT DOCUMENTS

| | | | | |
|---|---|---|---|---|
| 6,145,697 | A * | 11/2000 | Gudish | 221/3 |
| 6,325,241 | B1 * | 12/2001 | Garde et al. | 221/87 |
| 7,104,417 | B2 * | 9/2006 | Hilliard | 221/25 |
| 7,108,153 | B2 * | 9/2006 | Wood | 221/15 |
| 7,147,127 | B2 * | 12/2006 | Lepke et al. | 221/4 |
| 7,743,923 | B2 * | 6/2010 | Conley | 206/534.1 |
| 7,896,192 | B2 * | 3/2011 | Conley et al. | 221/15 |
| 8,195,330 | B2 * | 6/2012 | Coe | 700/243 |
| 2006/0124658 | A1 * | 6/2006 | Coe et al. | 221/121 |
| 2008/0203107 | A1 | 8/2008 | Conley et al. | |
| 2009/0071971 | A1 * | 3/2009 | Johnston et al. | 221/1 |
| 2010/0332023 | A1 * | 12/2010 | Tripathi et al. | 700/231 |

* cited by examiner

MEDICINE DISPENSING DEVICE WITH LOCKING INTERACTION BETWEEN HATCH AND DIVIDING WALL

TECHNICAL FIELD OF THE INVENTION

The present invention relates to a medicine dispensing device which comprises a shell-like base unit, a shell-like cassette with a number of compartments for storage of medicines which is rotatable relative to the base unit, means for rotating the cassette relative to the base unit, means for controlling the rotation means of the cassette, a lid firmly connected to the base unit and an aperture situated in the lid in such a way as to be brought central to any desired compartment of the cassette when the cassette is rotated.

STATE OF THE ART

A medicine dispensing device of the kind defined in the introduction is known from WO 96/19178. A disadvantage of that known device is that the period of time which elapses from a compartment being accessible to an adjacent compartment becoming accessible is relatively short. This means that the user might take two doses of medicine within that short period of time. This might of course lead to overdosing.

OBJECT AND FEATURES OF THE INVENTION

A primary object of the present invention is to propose a medicine dispensing device of the kind defined in the introduction which is such that the period of time which elapses between two neighbouring compartments in the cassette becoming accessible to the user is adjustable and well-defined. This period of time may, where necessary, be made long enough for there to be no risk of overdosing.

Another object of the present invention is that the period of time for which a compartment is accessible should be adjustable.

A further object of the present invention is that the accessibility of the compartments be controlled by means of a hatch which is of special constructional configuration.

At least the primary object of the present invention is achieved by a device which has the features indicated in the independent claim 1 set out below. Preferred embodiments of the invention are defined in the dependent claims.

BRIEF DESCRIPTION OF THE DRAWINGS

A preferred embodiment of the invention is described below with reference to the attached drawings, in which.

DETAILED DESCRIPTION OF A PREFERRED EMBODIMENT OF THE INVENTION

Figure 1:
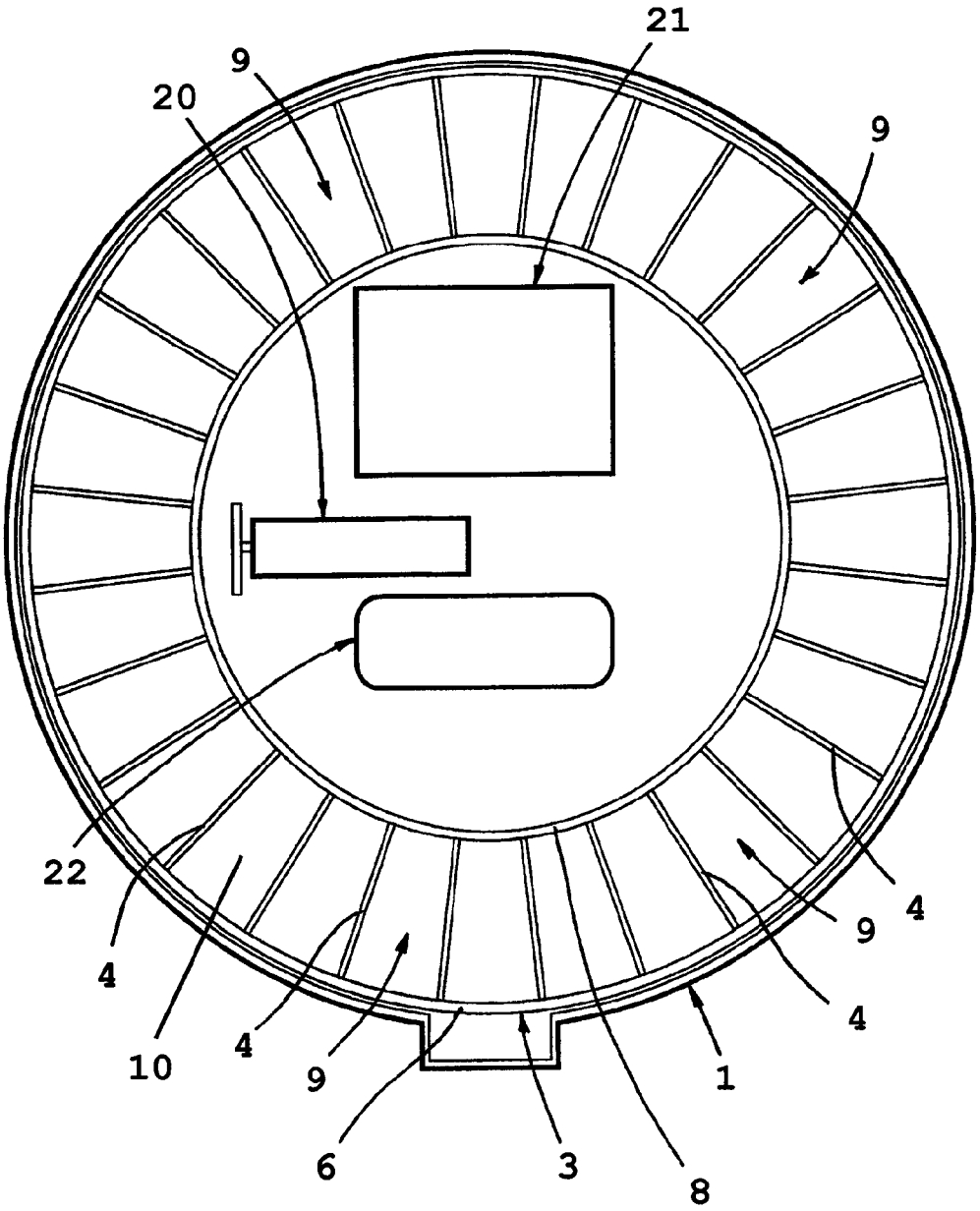
FIG. 1 is a plan view of a shell-like base unit and a cassette accommodated in it, schematically illustrating means for moving and controlling the cassette relative to the base unit.
Figure 2:
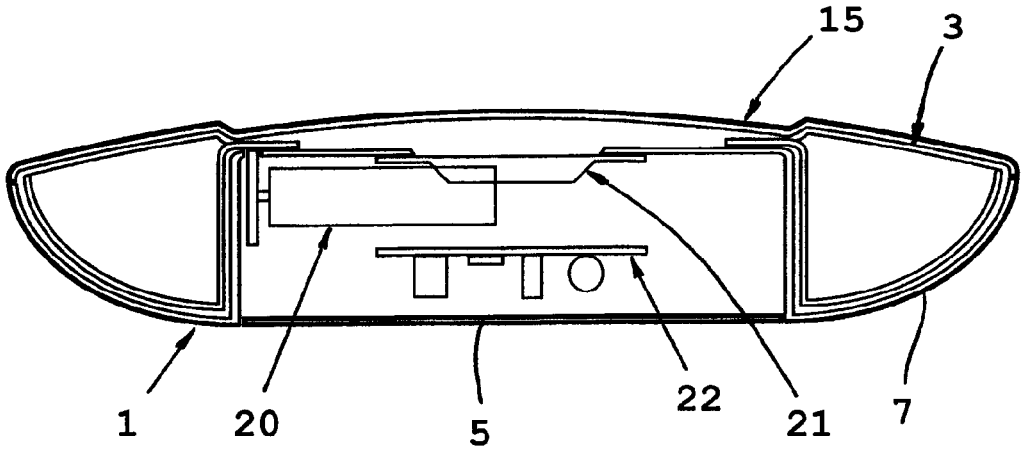
FIG. 2 is a schematic section through the device according to the present invention.

The base unit 1 and the cassette 3 depicted in FIGS. 1 and 2 thus form part of the medicine dispensing device according to the present invention. In the embodiment depicted, the base unit 1 is generally circular cylindrical in plan view, see FIG. 1. The base unit 1 has a bottom 5 and a sidewall 7 which runs along the periphery of the bottom 5. An aperture is defined at the edge of the sidewall 7 which faces away from the bottom 5.

The cassette 3 is likewise circular cylindrical in plan view, with a smaller diameter than the base unit 1. This makes it possible for the cassette 3 to be accommodated in the base unit 1. The cassette 3 has a number of first dividing walls 4 which extend radially and which define, in conjunction with an outer circumferential wall 6 and an inner circumferential wall 8, a number of compartments 9 along the circumference of the cassette 3. Each compartment 9 has also a bottom 10. Each compartment 9 is open in a direction away from the bottom 10.

As may be seen in FIG. 2, the medicine dispensing device according to the present invention has a lid 15 situated on top of the base unit 1.

FIGS. 1 and 2 depict schematically a motor 20, a clock 21 and a programme control unit 22. The motor 20 rotates the cassette 3 via a gear which may for example be of the toothed kind. The programme control unit 22 is programmable so that, in interaction with the clock 21, the cassette 3 is rotated at specific times so that another compartment 9 is caused to become central to the aperture 16 in the lid 15. This is prior art not only described in WO 96/19178 but also applied in a medicine dispensing device available on the market under trade mark Careousel®. The novelty to which the present invention refers is the hatch 17 and its constructional configuration.

Figure 3:
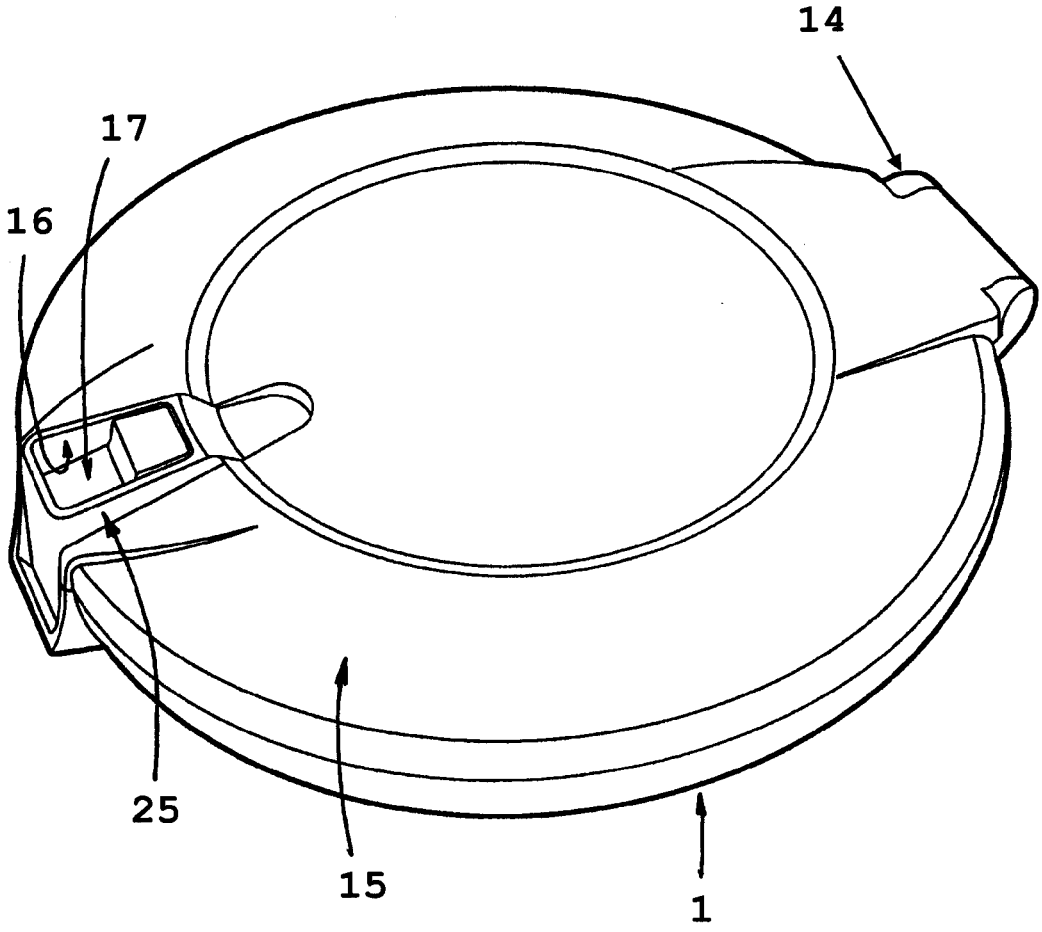
FIG. 3 is a perspective view from above of a medicine dispensing device according to the present invention.
Figure 4:
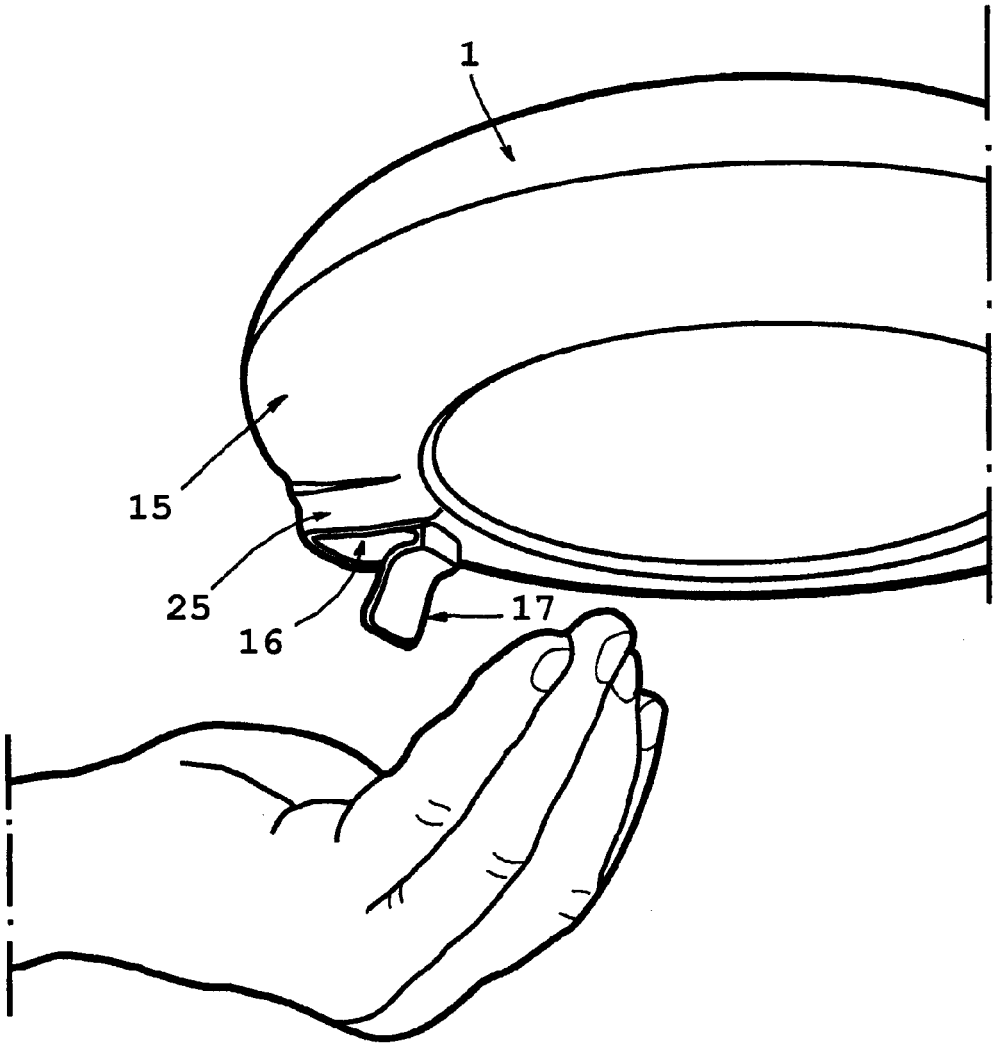
FIG. 4 is a perspective view of the medicine dispensing device according to the present invention in a state for delivering a dose of medicine, in which a hatch which forms part of the dispenser is open.

FIG. 3 is a perspective view of the device according to the present invention, in which the lid 15 is connected pivotably to the base unit 1 via a hinge 14. The lid 15 is provided with an aperture 16 which has in it a hatch 17. To take his/her medicine, a user has to turn the device upside down, see FIG. 4, whereupon the hatch 17, if central to a compartment 9, will assume the position depicted in FIG. 4, allowing a medicine which is in the compartment 9 to drop into the user's hand.

Figure 5:
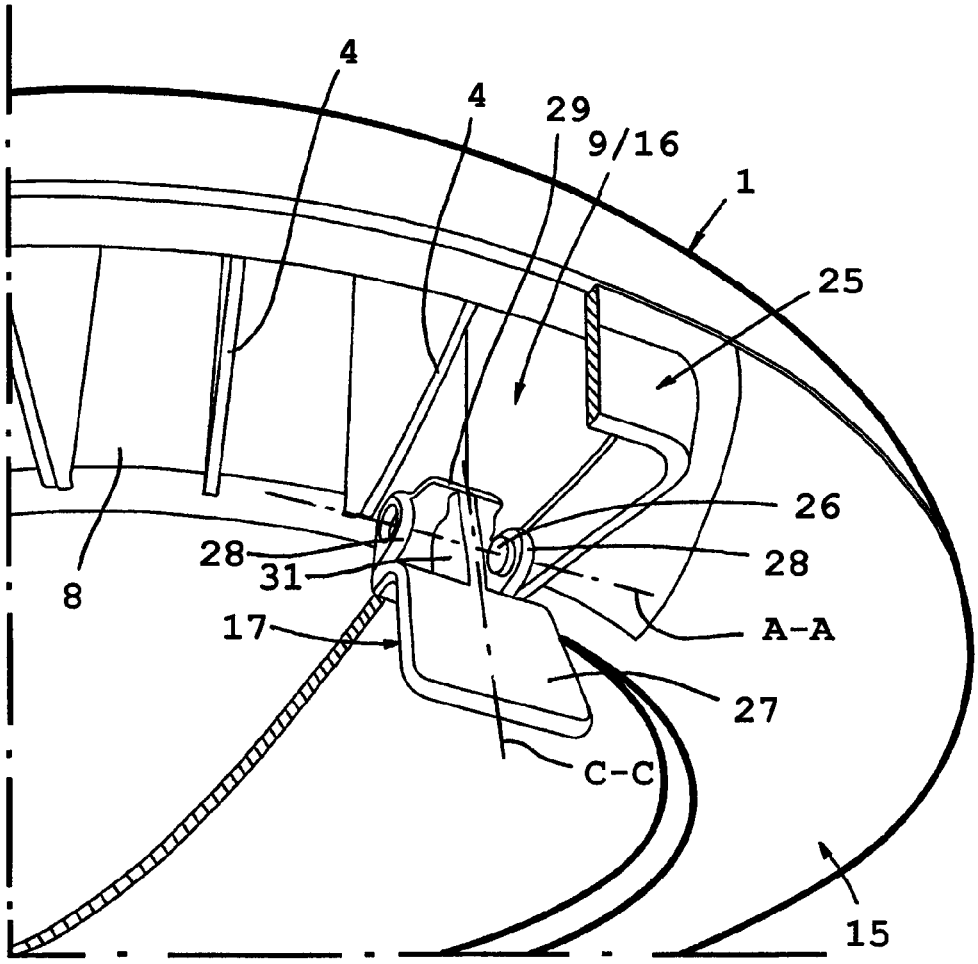
FIG. 5 is a partly sectional perspective view of part of the medicine dispensing device according to the present invention, illustrating the configuration of the hatch and how it interacts with the cassette.

FIG. 5 depicts in more detail the configuration of the hatch 17 and its fastening close to the aperture 16. The diagram illustrates an embodiment in which a collar 25 is provided round the aperture 16, showing for the sake of clarity only half of the collar. The inside of the collar 25 is provided with two mutually opposite spigots 26, only one of which is visible in FIG. 5, since only half of the collar is depicted.

The hatch 17 has a forward portion in the form of a tongue 27 with a forward edge 30, and a rear portion provided with fastening means in the form of two eyes 28. A centreline C-C of the hatch 17 depicted in FIG. 5 divides the hatch 17 into two equal parts. The centreline C-C defines also the hatch's longitudinal direction. The rear portion of the hatch 17 has a rear edge 29 which defines the hatch's rear end. This rear edge 29 extends across the centreline C-C.

The hatch 17 is provided with a second dividing wall 31 on the side of the rear portion which faces towards the compartment 9 when the hatch 17 assumes a closed position. The second dividing wall 31 extends between the tongue 27 and the rear edge 29. The second dividing wall 31 extends along the centreline C-C.

As illustrated in FIG. 5, the hatch 17 is fitted pivotably in the aperture 16 by the spigots 26 being accommodated in the eyes 28 (only one spigot 26 is depicted). The hatch 17 is pivotable about a pivot axis A-A. In FIG. 5 the hatch 17 has assumed an open position because it is central to a compartment 9 and its rear edge 29 has been allowed to pivot into the compartment 9. When the hatch 17 has assumed the open position as in FIG. 5 and the device is turned upside down, the medicine in the compartment 9 will drop into the user's hand, see FIG. 4.

The hatch 17 according to the present invention is so configured that the user will not have access to medicine in a compartment 9 before the hatch 17 has assumed a position central to an adjacent compartment 9, see FIG. 5. What happens in practice is that when access to a compartment 9 ceases, the cassette 3 rotates half a step, i.e. a distance corresponding in principle to half of the distance which the cassette 3 has to be rotated for the access positions for two adjacent compartments 9 to be reached. When it has been rotated half a step, the cassette 3 will remain in that position for a predetermined period of time. When the respective period has elapsed, the cassette 3 is again rotated half a step and a compartment 9 will then be central to the aperture 16 and hatch 17. The hatch 17 can then be opened. This is made possible by the constructional configuration of the hatch 17, and this function of the hatch 17 is illustrated in FIG. 5, in which the device is upside down.

Figure 6:
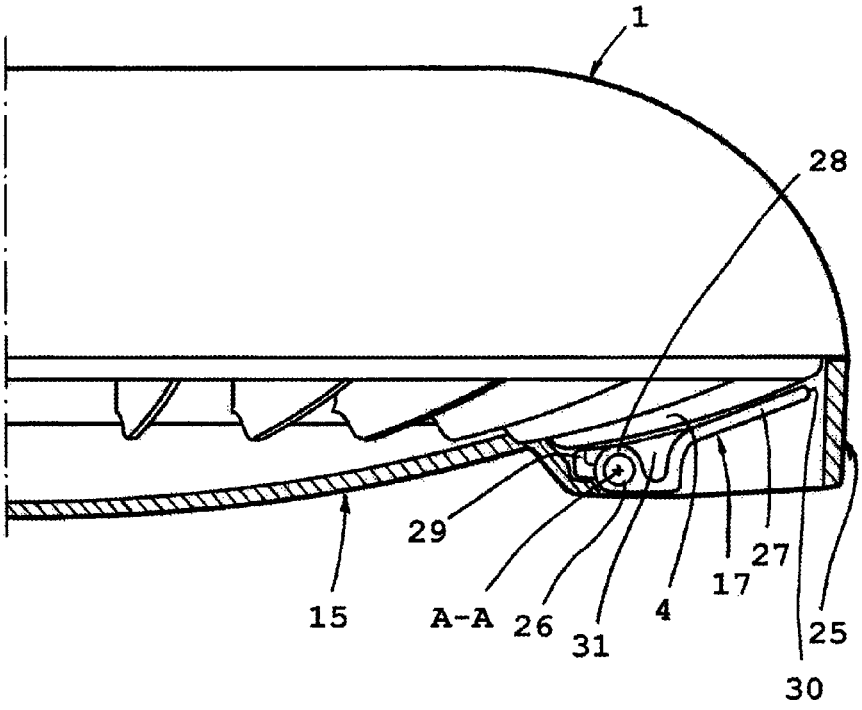
FIG. 6 is a partly sectional sideview illustrating the locking function of the hatch.

FIG. 6 shows how the rear edge 29 of the hatch 17, and more specifically the portion of the rear edge 29 which points towards the bottom 10 of the compartment 9, will abut against a radial first dividing wall 4 when the cassette 3 has been rotated half a step and the rear edge 29 is then central to a radial first dividing wall 4. Locking interaction is thus established between the rear edge 29 and the radial first dividing wall. This means that the hatch 17 is prevented from pivoting about the spigots 26, thus keeping it in the closed position depicted in FIG. 6 and preventing access to the compartment 9 which is within the hatch 17. In this context it should be noted that the distance between the rear edge 29 and the pivot axis A-A is substantially less than the distance between the forward edge 30 of the forward portion 27 and the pivot axis A-A.

Continued rotation of the cassette 3 for a further half-step will cause the hatch 17 to assume a position central to a compartment 9, with the result that the abutment of the rear edge 29 against a first dividing wall 4 will cease and the hatch 17 can be pivoted to the position depicted in FIG. 5, allowing the medicine in the compartment 9 to drop into the user's hand. In this context it should be noted that the extent of the rear edge 29 in the circumferential direction of the device is less than the distance between two mutually adjacent first radial dividing walls 4. This is necessary to enable the hatch 17 to assume the position in FIG. 5 when it is central to a compartment 9.

FIG. 6 shows the significance of the second dividing wall 31 in preventing medicine from being transferred from a compartment 9 to an adjacent compartment 9 when a first radial dividing wall 4 is central to the centreline C-C of the hatch 17.

Conceivable Modifications of the Invention

Figure 7:
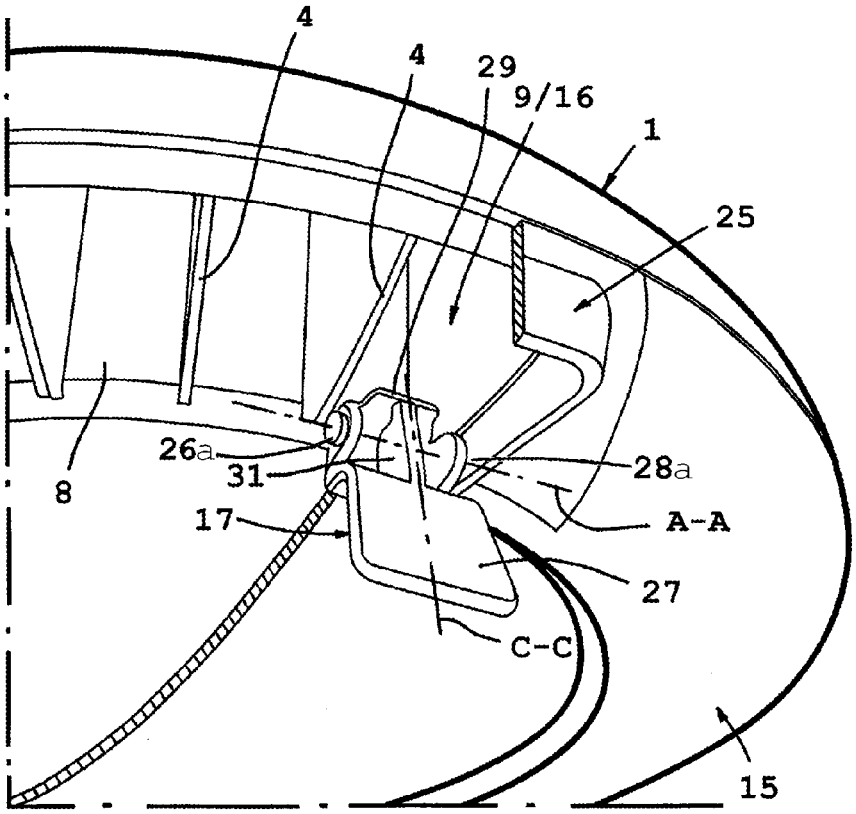
FIG. 7 is a partly sectional perspective view of part of the medicine dispensing device illustrating the configuration of the hatch and how it interacts with the cassette according to an alternate embodiment of the present invention.

In the embodiment described above, spigots 26 are provided on the collar 25, and eyes 28 are provided on the hatch 17. It is conceivable within the scope of the present invention that the spigots and eyes might be located vice versa, so that eyes are provided on the collar 25 and spigots on the hatch 17. An example of such an arrangement is shown in FIG. 7, wherein one of the two opposing spigots **26*a* is shown located on the hatch 17, and the location of one of the two opposing eyes on the collar 26 to accommodate the other of the two opposing spigots of the hatch 17 is indicated by the reference number 28*a***.

In the embodiment referred to above, the rear edge 29 is curved so that its free end extends towards a relating first radial dividing wall 4 when the hatch 17 assumes a closed position. When the medicine dispensing device is turned upside down, see FIG. 6, the curved free end of the rear edge 29 will abut against the relating first radial dividing wall 4. In this context it should however be noted that the configuration of the rear edge 29 might be different from that in the embodiment described. For exemplifying and non-limitative purposes it may be mentioned that the rear edge might have the shape of a beading or the like. In any case, however, the rear edge has to achieve fully locking interaction with the first radial dividing wall 4.

The invention claimed is:

1. A medicine dispensing device, comprising:

a base unit (1);

a cassette (3) with a plurality of compartments (9) for storage of medicines which is rotatable relative to the base unit;

means (20, 21, 22) for rotating the cassette (3) relative to the base unit (1) at predetermined times, a lid (15) firmly connected to the base unit (1); and an aperture (16) situated in the lid (15) in such a way that said aperture is movable to become central to any desired compartment (9) of the cassette (3) when the cassette (3) is rotated relative to the base unit (1) and the lid (15), wherein a hatch (17) is provided close to the aperture (16) and can assume a first position in which the aperture (16) is closed and a second position in which the aperture (16) is exposed, the hatch (17) being pivotable relative to a pivot axis (A-A), the hatch (17) having a rear edge (29) which has an extent in the circumferential direction of the device, the rear edge (29) being situated at a distance from the pivot axis of the hatch (17), and, when the hatch (17) closes the aperture (16), the rear edge (29) effects locking interaction with a radial first dividing wall (4) situated between neighbouring compartments (9).

2. The medicine dispensing device according to claim 1, wherein each compartment (9) is bounded laterally by two first radial dividing walls (4) situated at a distance from one another, and wherein the extent of the rear edge (29) in the circumferential direction is less than the distance between two neighbouring first radial dividing walls (4).

3. The medicine dispensing device according to claim 1, wherein the distance between the rear edge (29) and the pivot axis (A-A) is less than a distance between a forward edge (30) of a forward portion (27) of the hatch (17) and the pivot axis (A-A).

4. The medicine dispensing device according to claim 3, wherein the distance between the forward edge (30) and the pivot axis (A-A) is several times the distance between the rear edge (29) and the pivot axis (A-A).

5. The medicine dispensing device according to claim 1, wherein the hatch (17) is provided with two mutually opposite eyes (28) situated at a distance from one another in the circumferential direction, and wherein two mutually opposite spigots (26) are situated on a collar (25) which surrounds the aperture (16) and are accommodated in the eyes (28).

6. The medicine dispensing device according to claim 5, wherein a second dividing wall (31) is provided between the eyes (28) and that said second dividing wall (31) extends across the rear edge (29).

7. The medicine dispensing device according to claim 1, wherein the hatch (17) is provided with two mutually opposite spigots, and wherein two mutually opposite eyes are situated on a collar (25) which surrounds the aperture (16) and configured to accommodate the spigots.

8. The medicine dispensing device according to claim 2, wherein the distance between the rear edge (29) and the pivot axis (A-A) is less than a distance between a forward edge (30) of a forward portion (27) of the hatch (17) and the pivot axis (A-A).

9. The medicine dispensing device according to claim 2, wherein the hatch (17) is provided with two mutually opposite eyes (28) situated at a distance from one another in the circumferential direction, and wherein two mutually opposite spigots (26) are situated on a collar (25) which surrounds the aperture (16) and are accommodated in the eyes (28).

10. The medicine dispensing device according to claim 3, wherein the hatch (17) is provided with two mutually opposite eyes (28) situated at a distance from one another in the circumferential direction, and wherein two mutually opposite spigots (26) are situated on a collar (25) which surrounds the aperture (16) and are accommodated in the eyes (28).

11. The medicine dispensing device according to claim 4, wherein the hatch (17) is provided with two mutually opposite eyes (28) situated at a distance from one another in the circumferential direction, and wherein two mutually opposite spigots (26) are situated on a collar (25) which surrounds the aperture (16) and are accommodated in the eyes (28).

12. The medicine dispensing device according to claim 2, wherein the hatch (17) is provided with two mutually opposite spigots, and wherein two mutually opposite eyes are situated on a collar (25) which surrounds the aperture (16) and are configured to accommodate the spigots.

13. The medicine dispensing device according to claim 3, wherein the hatch (17) is provided with two mutually opposite spigots, and wherein two mutually opposite eyes are situated on a collar (25) which surrounds the aperture (16) and are configured to accommodate the spigots.

14. The medicine dispensing device according to claim 4, wherein the hatch (17) is provided with two mutually opposite spigots, and wherein two mutually opposite eyes are situated on a collar (25) which surrounds the aperture (16) and are configured to accommodate the spigots.

15. The medicine dispensing device according to claim 8, wherein the hatch (17) is provided with two mutually opposite eyes (28) situated at a distance from one another in the circumferential direction, and wherein two mutually opposite spigots (26) are situated on a collar (25) which surrounds the aperture (16) and are accommodated in the eyes (28).

16. The medicine dispensing device according to claim 8, wherein the hatch (17) is provided with two mutually opposite spigots, and wherein two mutually opposite eyes are situated on a collar (25) which surrounds the aperture (16) and are configured to accommodate the spigots.

* * * * *